US007252161B2

(12) United States Patent
Ayling

(10) Patent No.: US 7,252,161 B2
(45) Date of Patent: Aug. 7, 2007

(54) METHOD AND APPARATUS WITH SLIPS ASSEMBLY FOR COUPLING TUBULARS WITHOUT INTERRUPTION OF CIRCULATION

(75) Inventor: Laurence John Ayling, Camberley (GB)

(73) Assignee: Coupler Developments Limited, Douglas, Isle of Mann (GB)

( * ) Notice: Subject to any disclaimer, the term of this patent is extended or adjusted under 35 U.S.C. 154(b) by 211 days.

(21) Appl. No.: 10/483,013

(22) PCT Filed: Jul. 1, 2002

(86) PCT No.: PCT/GB02/03031

§ 371 (c)(1),
(2), (4) Date: Jun. 28, 2004

(87) PCT Pub. No.: WO03/004827

PCT Pub. Date: Jan. 16, 2003

(65) Prior Publication Data

US 2005/0006147 A1 Jan. 13, 2005

(30) Foreign Application Priority Data

Jul. 6, 2001 (GB) ..... 0116563.8

(51) Int. Cl.
*E21B 19/10* (2006.01)

(52) U.S. Cl. ..... 175/57; 175/423

(58) Field of Classification Search ..... 166/77.51, 166/77.53, 85.1
See application file for complete search history.

(56) References Cited

U.S. PATENT DOCUMENTS

| | | | | |
|---|---|---|---|---|
| 3,722,603 | A * | 3/1973 | Brown | 173/159 |
| 3,748,702 | A * | 7/1973 | Brown | 188/67 |
| 4,203,182 | A | 5/1980 | Boyadjieff et al. | |
| 4,389,760 | A * | 6/1983 | Krasnov | 188/67 |
| 5,297,833 | A * | 3/1994 | Willis et al. | 294/102.2 |
| 5,351,767 | A * | 10/1994 | Stogner et al. | 175/162 |
| 6,119,772 | A | 9/2000 | Pruet | |
| 6,412,554 | B1 | 7/2002 | Allen et al. | |
| 6,470,975 | B1 * | 10/2002 | Bourgoyne et al. | 175/57 |

FOREIGN PATENT DOCUMENTS

| | | |
|---|---|---|
| DE | 2658431 | 6/1978 |
| DE | 3105565 | 9/1982 |

* cited by examiner

*Primary Examiner*—Frank Tsay
(74) *Attorney, Agent, or Firm*—Bartlett & Sherer; Ronald B. Sherer; Gerow D. Brill

(57) ABSTRACT

A slips assembly which comprises a plurality of slip segments which, when positioned adjacent to each other, form a collar, which collar is larger than the diameter of the tubular body of the tubular at the top of the drill string and smaller than the diameter the upset shoulder of the said tubular, there being a segment moving means which can move the segments together to from a collar slidably located around the body of the said tubular, which slips assemblies can also be utilised in conjunction with, or as part of, the couplers referred to in prior patent applications, either to support, raise or lower the string below, or restraint, lower or raise the tubular, or stand of tubulars, above.

27 Claims, 5 Drawing Sheets

METHOD AND APPARATUS WITH SLIPS ASSEMBLY FOR COUPLING TUBULARS WITHOUT INTERRUPTION OF CIRCULATION

This invention relates to drilling wells, and, more particularly to methods and apparatus for drilling wells more efficiently and safely.

It is well known in the drilling industry, and particularly in the field of drilling for oil and gas, that drill strings comprise a large plurality of tubular sections, drill pipes, joints of tubing, casing or conductors, hereinafter referred to as "tubulars", which are connected by male threads on the pins and female threads in the boxes. It is also well known that such tubulars must be added to the string of tubulars down the hole, hereinafter referred to as the "string", one by one or in "stands" of 2 or 3 already connected tubulars, as the string is lowered into the hole drilled or being drilled. When it is necessary to withdraw the string, in whole or in part, each tubular or stand of tubulars has to be unscrewed one by one from the string as the string is raised to the extent required.

Each time a new tubular is to be added to the string, the string is raised and "slips" are placed around the topmost part of the string, a few feet below the top tool joint and these become wedged between the string and the slips bowl when the string is lowered; the weight of the string is thereby passed from the Top Drive to the slips. The slips are thereby "set" and grip the string enough to prevent the string from dropping back into the hole.

This gripping relies on a combination of friction and indentation of the string. Friction is generally not enough to prevent the string slipping and so the slips have metal inserts, which have a plurality of protrusions, which bite into the metal surface of the string. Although, designed to minimise damage to the surface of the string, inevitably the surface suffers plastic deformation and repeated gripping causes permanent and increasing damage. Additionally, this area of the string is located close to what is recognised as the high stress area, being close to the tool joint, which is necessarily more rigid. When the string is required to bend, the transition area between the rigid tool joint and the more flexible tubular shaft, or body, is a high stress area This is the area that tends to fail first and any damage to the tubular surface makes such failures more likely.

Patent Applications PCT/GB/02815 and PCT/GB/03411, the contents of which are hereby incorporated by reference, describe the making and breaking of tool joint connections under pressure inside a "Coupler", so that mud circulation can continue uninterrupted. When using such a Coupler, there is a significant upward force on the tubular being added or removed due to the internal mud pressure within the coupler. Hence, the tubular has to be restrained from being forced upwards and out of the out the Coupler and for this purpose an 'upside-down' slips action is required, which can most conventionally be applied directly to the surface of the tubular shaft, or body. This too relies on gripping by indentation of the body surface; but at the other high stress area which is just above the tool joint.

The above patent applications, referred to, highlight the benefits of using the shoulder of the tool joint upset to resist axial movement of the string or tubular instead of relying on indentation of the body surface but the methods illustrated in those patent applications are complicated and occupy a relatively large amount of space We have now devised an improved and simple method of actuating slips segments to form a continuous slips collar around the tubular, to act on the upset shoulder without damaging the tubular body.

According to the invention there is provided a slips assembly which comprises a plurality of slip segments which, when positioned adjacent to each other, form a collar, which collar is larger than the diameter of the tubular body of the tubular at the top of the drill string and smaller than the diameter the upset shoulder of the said tubular, there being a segment moving means which can move the segments together to form a collar which can be slidably located around the body of the said tubular.

In use the segments are moved together to form a continuous but loose collar around the string or tubular and can then be slid up, or down, to engage the shoulder of the tool joint upset.

Concerning, first, the application of this invention to the supporting of the string; the slips are located in the slips body, which is a continuous ring, supported on bearing mounted on the rig floor, rotary table or even the BOP stack, used in conventional drilling equipment.

Preferably the slips segments are connected to the slips body by a sliding keyway and are also connected to the slips base, which is a continuous collar, encircling the box that serves the important purpose of ensuring that all the slips segments move in and out equally, preferably by a sliding keyway. Thus in use when the slips base is moved away from the slips body, the slips segments move outwards from the axis of the string until they are clear of the passage of the relevant tool joints through the slips assembly.

A preferred arrangement of the actuation of the slips segments is that the slips segments are guided by key ways in the slips body and slips base, such that the slips segments are forced to follow a controlled path and the slips base itself ensures that the slips segments come together to form a perfectly aligned collar around the tubular. The keyways are preferably loose and smooth but can have a surface treatment to reduce friction.

The slips base can be actuated up and down by mechanical, electrical or hydraulic means.

The slips base may, for some applications be preferred to retract under the force of a spring, such that hydraulic pressure is only exerted to move the slips base away from the slips body. In this way the slips segments can be extended to form a slips collar around the string and, as the string is withdrawn from the well, each tool joint forces the slips segments apart as it passes; the segments sliding together again, under spring action, after each tool joint has passed. In this way, any hydraulic failure results in the slips segments extending and therefore being 'fail safe' in operation. However, it is preferred that the extension of the slips segments to form the slips collar, is particularly forceful, since the string may not otherwise be centralised within the slips assembly and the force required to centralise the body, may be considerable.

The slips segments are preferably located in a conical slips body which tapers upwards and outwards so that downward force applied to the segments by the upset shoulder will hold the slip segments together. The slips segments are wedged between the upset shoulder and the conical slips body such that the greater the force applied by the upset shoulder, the greater the force holding the slips segments together.

Preferably the surface of the slips segments adjacent the tubular is at angle to the axis of the tubular, which angle is slightly less than the angle of the upset shoulder to the axis of the tubular so that downward pressure on the segments, due to the weight of the drill string, is applied by the top end of the upset shoulder. For example, could be up to 2 degrees less than the angle of the shoulder to the tubular axis, as is discussed later.

Despite the small angle of the shoulder to the tubular axis, which can be as little as 15°, the high force exerted by the weight of the string, which can be several miles long, is transferred directly through the slips body and the slips bearing, to the slips carrier. The slips assembly can rotate with the string. The slips carrier, however, can be static in all directions, as is most likely when supporting a drill string, or it can be raised or lowered when handling a tubular or when used inside a Coupler.

The faces in contact with the slips body are preferably at such an angular slope compared to that of the faces in contact with the upset shoulder, that the slips segments are neither squeezed out by the compressive forces at these two faces, nor do they become overly jammed between them. Such a slope is typically 1 in 6 when designing conventional slips. In conventional slips, each slips segment (typically 3 in number) supports a number of inserts, each of which has a number of protrusions (typically 40). These slips segments cannot form a continuous collar since they must continue to move inwards as the protrusions penetrate the body.

The faces in contact with the shoulder and with the slips body are designed to spread the forces over the maximum areas available and to transmit the forces over the shortest path possible. Similarly the slips body is designed to transmit these forces over the shortest distance to the bearing and thence to the rig and/or well structure.

A feature of this invention is that, unlike the conventional use of slips acting on the body of the tubular, the slips segments apply the force over the whole surface of the upset shoulder and it is not required that the slips segments rely either on friction or on penetration of the metal surface of the shoulder. Thus no 'marking', plastic deformation or damage is inflicted on the tubular body.

A feature of this invention is that, if the axial force of the weight of the string or the pressure on the tubular is high enough to exceed the elastic deformation of the surface of the upset shoulder, the resulting plastic deformation takes place preferentially at the least stressed part of the tool joint.

This slips assembly can also be used upside down to hold a tubular downwards, when it is being pushed into, or 'snubbed', into a high pressure space, as is required when a tubular or stand of tubulars are being introduced into a well, or a coupler, which is already high pressure.

Whether applied to supporting a string or subbing a tubular, the slips carrier can be moved axially, up and down, to enable slips segments to move into contact with the upset shoulder and, subsequently to raise or lower the string, or the tubular, respectively.

An advantage of the systems of the present invention over conventional slipping systems is that slipping on the upset shoulder is more positive and reliable than relying on friction and surface penetration and is therefore safer. Additionally the present invention, in which the slips segments described herein provide a method of achieving this concept, provides a technical solution which combines simplicity, compactness and practicality and enables the prior patents referred to above to be applied with better effect.

This invention combines prior art and new techniques in a simple and compact slips assembly that can support the string and/or restrain the tubular, when making or breaking connections, with or without the use of a Coupler.

The slips assembly of the present invention can be used with a coupler of the type described in Patent Applications PCT/GB97/02815 and PCT/GB99/03411 either outside and beneath or within the coupler.

In Patent Application PCT/GB97/02815 there is provided a coupler for use in continuous drilling in which a drill string is rotated from a top drive rotating means and drilling fluid is circulated down the drill string which coupler comprises a means to grip the drill string and means to grip and seal a tubular lowered from substantially above, and the upper and lower sections of the coupler being inside a chamber separated into an upper half and a lower half by a blind preventer which, in its closed position prevents escape of drilling fluid from the drill stand, whereby when the blind preventer is opened the tubular and the drill stand can be brought into contact and joined together. The slips assembly of the present invention can be used in the upper or lower half of the chamber.

In Patent Application PCT/GB99/03411 there is provided a well head assembly which comprises a BOP stack above which there are positioned sequentially: (i) a lower annular preventer (ii) lower grips and slips adapted to engage a downhole drill string (iii) a blind preventer (iv) upper grips and slips adapted to engage a tubular to be added to the drill string and (v) an upper annular preventer and in which the upper grips and slips are able to pass through the blind preventer when the blind preventer is in the open position.

The orientation of the well head assembly refers to the well head assembly when in position on a drill string.

The slips assembly of the present invention can be used with the upper and/or lower slips.

The invention is illustrated in the accompanying drawings in which.

Figure 4A:
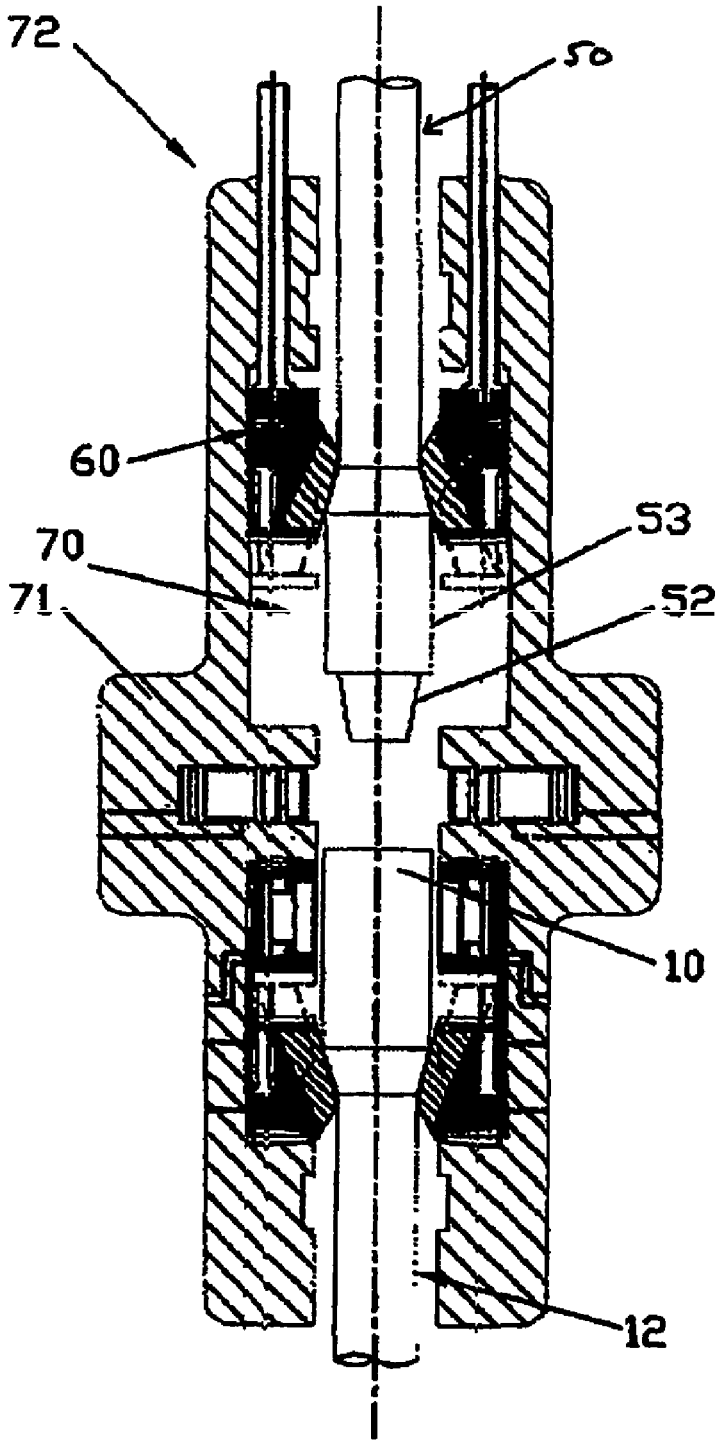
Figure 4B:
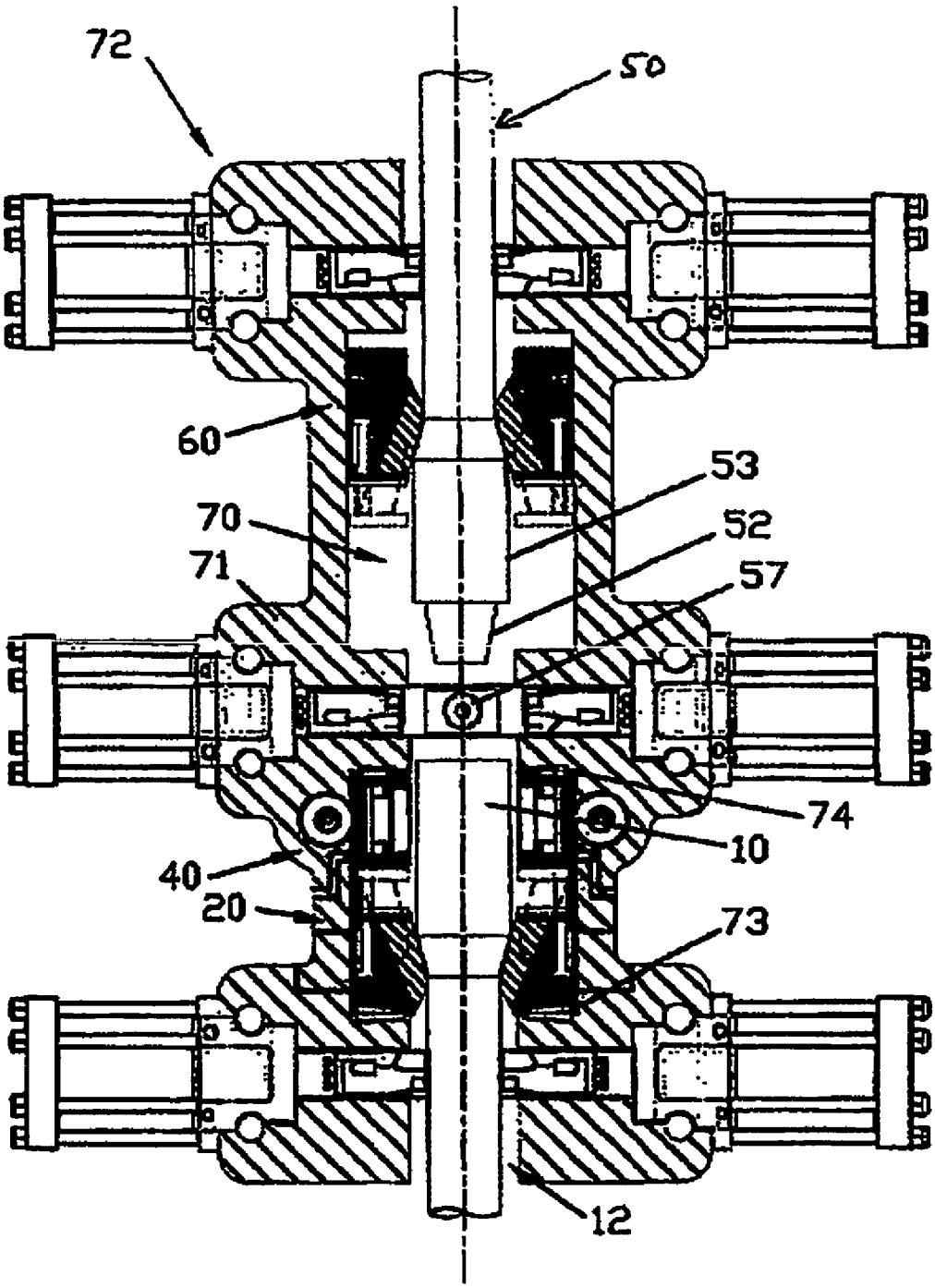

FIGS. 4*a* and 4*b* are a cross section of a Coupler, using slips assemblies to restrain both the drill string and the tubular within a Coupler and used in conjunction with grips to apply torque.

Figure 1:
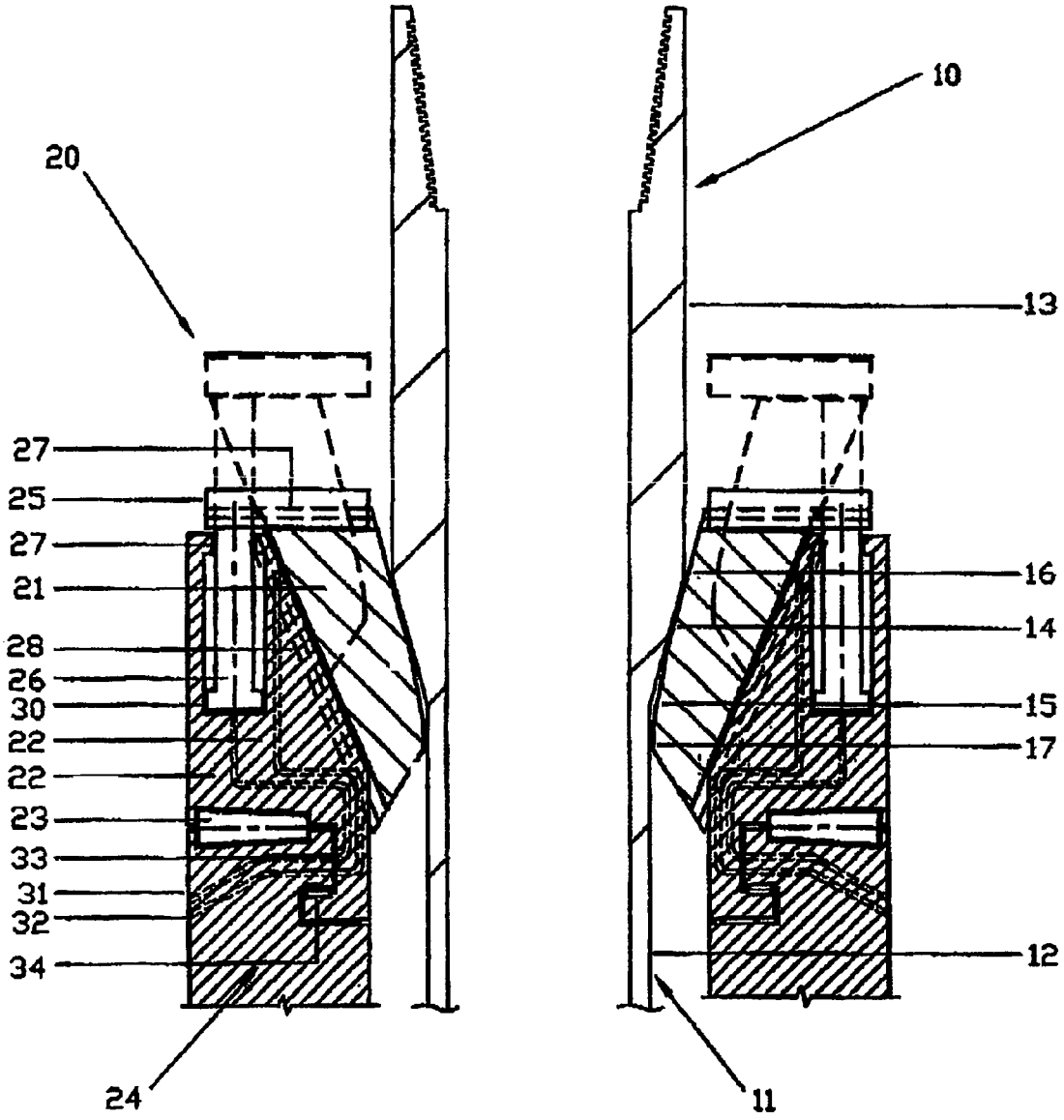
FIG. 1 is a cross section of the slips assembly, supporting a string

Referring to FIG. 1, the top end of the string is shown, which consists of the tool joint box 10 and the top of the uppermost tubular 11 in the string. The shaft or body 12 of the string is of smaller diameter than that of the upset of the box 10. The transition between the body 12 and upset 13 is the shoulder 14, which is usually at 30° to the axis of the tubular but 15° is becoming popular.

The shape of the shoulder's root 15 is varies depending on the manufacturer. The outside diameter of the body 11 is a quoted nominal standard and the diameter of the upset 13 is also specific. However the upset diameter reduces as the tool joint becomes worn. The area of body 12 immediately adjacent to the box 10 does not wear significantly but is often of larger diameter than the quoted nominal standard OD of the tubular 11, depending again on the manufacturer.

Referring to FIG. 1, this invention essentially involves a slips assembly 20 in which two or more slips segments 21 come together to form a continuous collar around the body 12 without gripping the body 12.

The string is lowered until the shoulder 14 of the box 10 contacts the slip segments 21, at which time the weight of the string is supported by the slips segments 21, which are themselves wedged within the slips body 22, which is a continuous ring, supported on bearing 23, mounted on the rig floor, rotary table or even the BOP stack, 24, which are conventional drilling equipments.

The innovative aspects of this invention are the actuation of the slips segments 21 and the configuration of the slips segments 21 as follows;

Concerning the actuation, the slips segments 21 are connected to the slips body 22 by a sliding keyway 28 and are also connected to the slips base 25 by a sliding keyway 27. Thus when the slips base 25 is moved away from the slips body 22, the slips segments 21 move outwards from the axis of the string until they are clear of the passage of the relevant tool joints through the slips assembly.

The slips base 25 is actuated up and down by shaft 26 which can be mechanical, electrical or hydraulic. The hydraulic method shown requires pressure seals at 29 & 30 and is powered by hydraulic fluid passing via passages 31 & 32 and the slip-rings at 33. A small bearing 34 is shown to complement the main bearing 23.

The slips base 25 may, for some applications be preferred to retract under the force of a spring, such that hydraulic pressure is only exerted to extend it. In this way the slips segments 21 can be extended to form a slips collar around the string and as the sting is withdrawn from the well, each tool joint forces the slips segments apart as it passes; the segments sliding together again under spring action after each tool joint has passed. However, it is preferred that the extension of the slips segments 21 to form the slips collar, is particularly forceful, since the string may not otherwise be centralised within the slips assembly 20 and the force to centralise the body 11 may be considerable.

Concerning the configuration of the slips segments 21, the faces in contact with the upset shoulder 14 are designed to be the same angle of slope as that of the shoulder 14, less a fraction of a degree to ensure that any plastic deformation of the shoulder takes place preferentially near the peak 16, rather than near the root 15, which is a relatively high stress area compared with the peak 16. Additionally, these particular faces of the slips segments 21 are cut back near the root 15 to avoid contact with the variously shaped surface at the root 15.

The faces in contact with the slips body 22 are at such an angular slope compared to that of the faces in contact with the shoulder 14, that the slips segments are neither squeezed out by the compressive forces at these two faces, nor do they become overly jammed between them. Such a slope is typically 1 in 6 when designing conventional slips. (In conventional slips, each slips segment (typically 3 in number) supports a number of inserts, each of which has a number of protrusions (typically 40). These slips segments cannot form a continuous collar since they must continue to move inwards as the protrusions penetrate the body.)

The faces in contact with the shoulder 14 and with the slips body 22 are designed to spread the forces over the maximum areas available and to transmit the forces over the shortest path possible. Similarly the slips body 22 is designed to transmit these forces over the shortest distance to the bearing 23 and thence to the rig and/or well structure.

The keyways 27 & 28 are designed to be loose and smooth but may require surface treatment to reduce friction.

The slips base 25 is a continuous collar, encircling the box 10, that serves the important purpose of ensuring that all the slips segments 21 move in and out equally.

The vertical surface 17 serves only to force the body 12 into the centre line of the slips assembly 20, as the slips segments 21 move inwards to form the collar.

Figure 2:
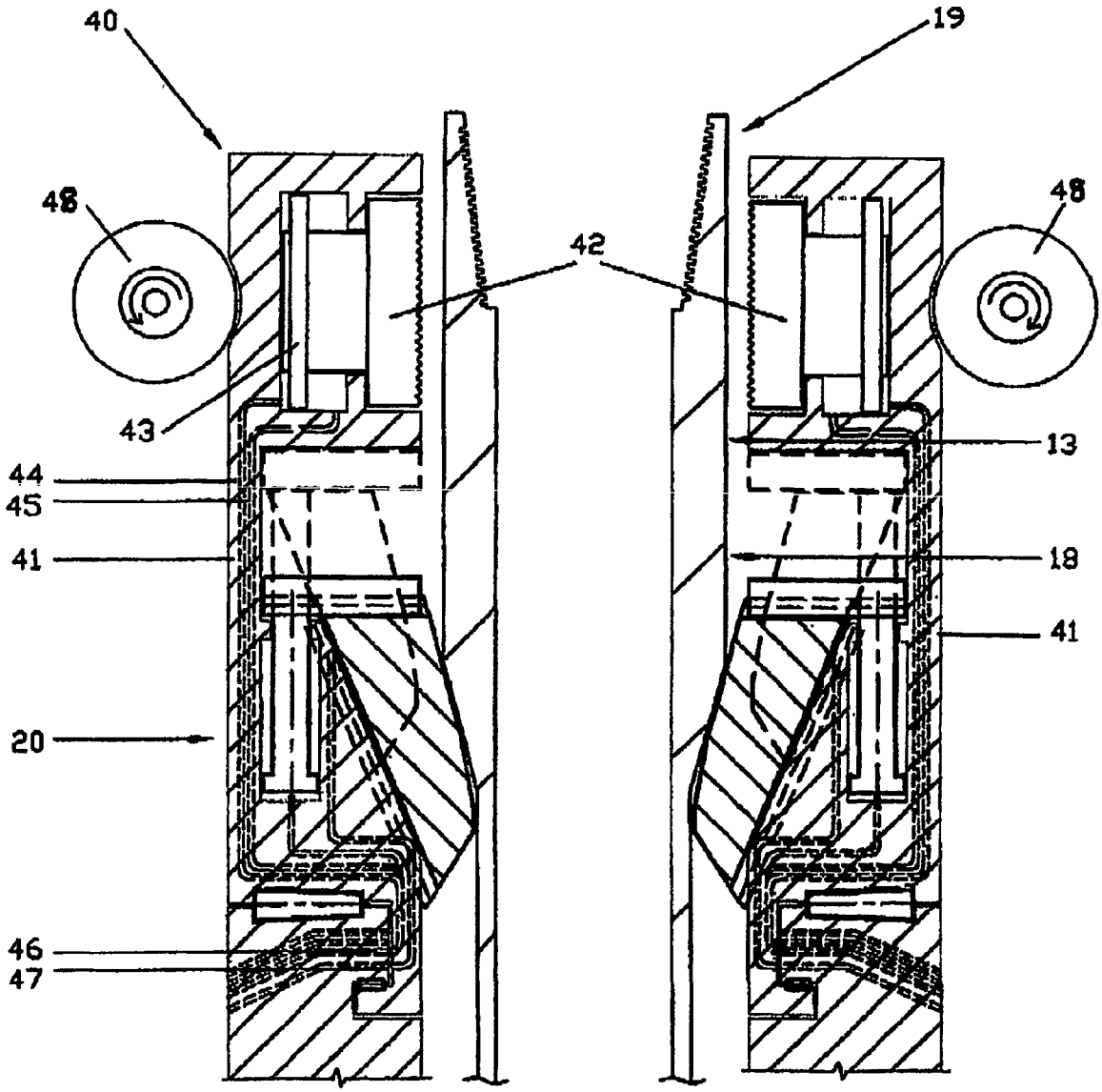
FIG. 2 is a cross section of the slips assembly, supporting a string and used in conjunction with grips to apply torque.

FIG. 2 shows the preferred relationship between the grips and slips assemblies 40 & 20 in an application of the invention, wherein the conventional slipping and gripping of the body is replaced by slipping on the shoulder and gripping of the upset. The grips 42 act on the upset 13 in the optimum area well clear of the hard banding area 18 and the weaker extremity of the box 19.

The gripping assembly 40 which is connected 41 to the slips assembly 20, can be driven mechanically, electrically or hydraulically. The drives are shown as a pair of hypoid gear wheels 48 for illustrative purposes. The grips 42 can be actuated hydraulically via passages 44 & 45, through additional slip-ring seals 46 & 47.

This slips & grips assembly 40 & 20, can be positioned some 3 ft proud of the rig floor, above the conventional rotary table in order to operate tongs above it at a convenient and ergonomic height.

Figure 3:
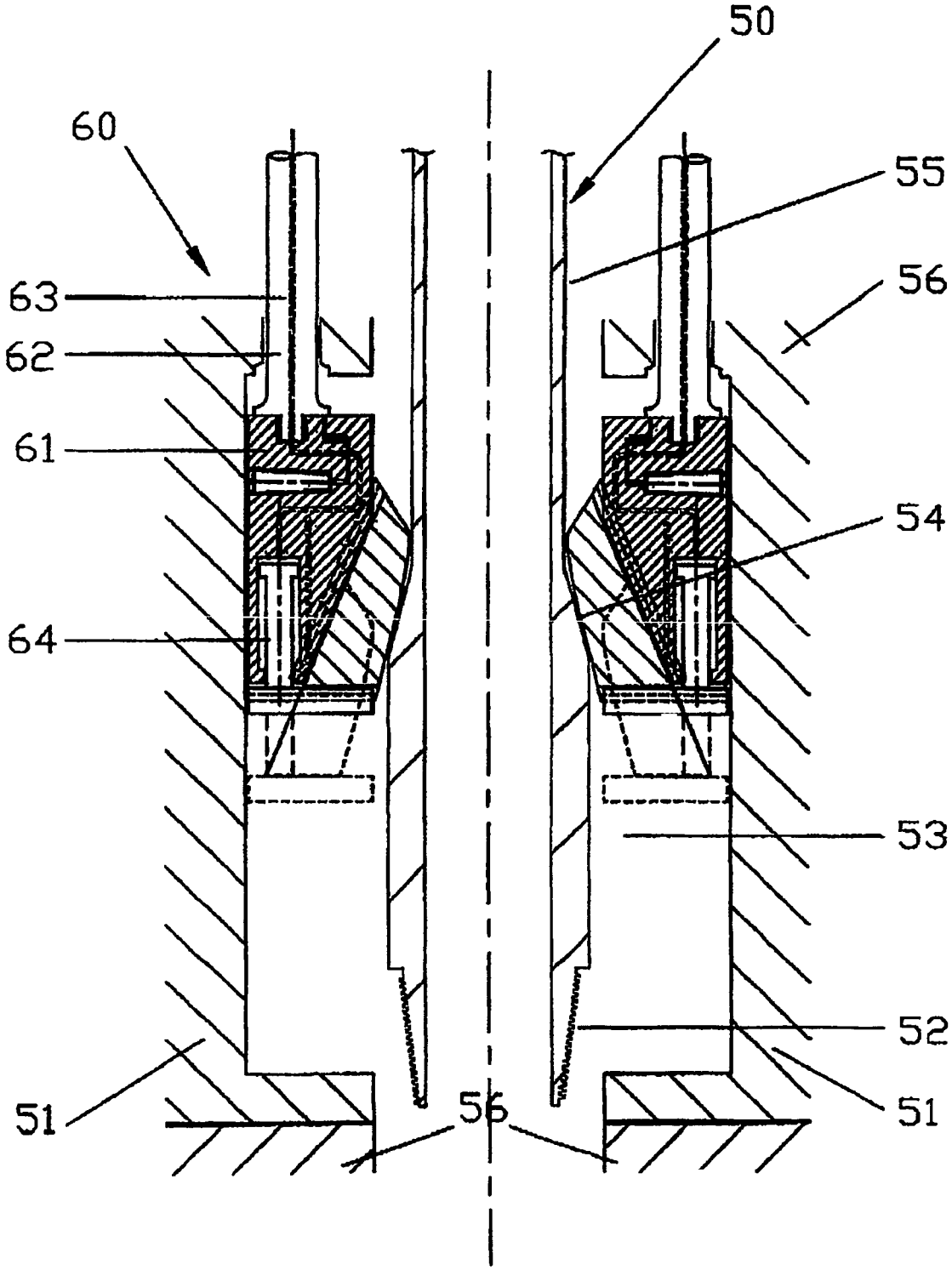
FIG. 3 is a cross section of the slips assembly, used to hold a tubular down and within a Coupler under internal pressure.

FIG. 3 shows the upside down application of the slips assembly 60 when restraining a tubular 50 from being forced out of a pressure hull 51 under high internal pressure. The bottom section of the tubular 50 is shown, comprising the tool joint pin 52, pin upset 53, upset shoulder 54 and tubular body 55.

All key aspects listed for the slips assembly of FIG. 1 apply to FIG. 3.

Additionally, there is a slips carrier 61, which can be moved vertically within the pressure hull 51, by axial movement of 2 or more shafts 62, through which the hydraulic supplies 63 to actuate the slips actuation cylinders 64 can pass.

The whole slips assembly 60 can thereby be lowered to pass the pin 52 down through the blind ram or valve 56 of a Coupler. The necessary gripping of the pin upset 53 when the tool joint connection is to be broken is shown in FIGS. 4*a* and 4*b*.

The configuration shown is the most compact way known of containing a slips assembly within a diameter of some 18¾" within a pressure hull capable of passing tool joints of up to 9 inches in diameter. Such pressure hull 51 typically being capable of operating at 5,000 psi.

FIGS. 4*a* and 4*b* shows the application of this innovative slips assembly in conjunction with two sets of grips, within a Coupler as previously described in the patent applications referred to above as follows:

The slips assembly 60 serves to restrain the tubular 50 from being forced upwards and out of the high pressure space 70 within the pressure hull 71 of the Coupler 72.

This slips assembly 60 can be moved downwards so that the pin 52 enters and can be screwed into the box 10 and the of the topmost tubular of the string 12

The bearings, allowing the slips assembly 20 and grips assembly 40 to rotate are located below 73 and above 74.

The features of this invention, when applied to the Couplers described in the referenced patents, are the compact method of actuation, which enables the pressure hull to be minimised in size and weight and the shape of the slips segments, which enable force to be applied to the upset shoulder in the most efficient and safe manner, both of the string and of the tubular.

The invention claimed is:

1. A combination of a coupler and a slips assembly for preventing axial movement of a tubular including a tool joint box having a shoulder wherein said slips assembly comprises a plurality of slips segments arranged about said tubular and axially positioned to engage said shoulder; and means for moving said slips segments to engage said shoulder as a continuous collar; and wherein said coupler comprises a pressure hull, a pair of first and second grips and a valve partition; and wherein said slips assembly is positioned between said valve partition and one of said first and second grips.

2. A slips assembly for use with a drill string comprising tubulars, which slips assembly comprises a slips base and a slips body and in which there are a plurality of slips which, when positioned adjacent to each other, form a collar, which collar is larger than the diameter of the tubular body of the tubular body of the tubular at the top of the drill string and smaller than the diameter of the upset shoulder of the tubular, including slip moving means for moving said slips together to form a collar which can be slidably located around the body of the said tubular; and in which the surfaces of said slips adjacent to the tubular are at angle to the axis of said tubular, which angle is less than the angle of the upset shoulder so that downward pressure on said slips due to the weight of the drill string is applied to the top end of the upset shoulder; and in which said surfaces of said slips are at an angle to the tubular axis of less than 2 degrees less than said angle of the shoulder to the tubular axis.

3. A slips assembly for use with a drill string comprising tubulars, which slips assembly comprises a slips base and a slips body, and in which there are a plurality of slip segments in said body which, when positioned adjacent to each other, form a collar, which collar is larger than the diameter of the tubular body of the tubular at the top of the drill string and smaller than the diameter of the upset shoulder of the tubular, and including segment moving means for moving the segments together to form a collar which can be slidably located around the body of the said tubular, and in which said slips body is supported on a bearing mounted on a rig floor, rotary table or blow out preventer stack.

4. A coupler and slips assembly for use with a drill string comprising tubulars, which slips assembly comprises a slips base and a slips body and in which there are a plurality of slip segments which, when positioned adjacent to each other, form a collar, which collar is larger than the diameter of the tubular body of the tubular at the top of the drill string and smaller than the diameter of the upset shoulder of the said tubular, including slip segment moving means for moving said slip segments together to form a collar which can be slidably located around the body of said tubular; and wherein said slips assembly is positioned outside and beneath said coupler for use in continuous drilling in which a drill string is rotated from a top drive rotating means and drilling fluid is circulated down the drill string, and in which said coupler comprises a means to grip the drill string and means to grip and seal a tubular lowered from substantially above, and having upper and lower chamber portions inside a chamber separated by a blind preventer which, in its closed position prevents escape of drilling fluid from the drill stand, whereby when said blind preventer is opened the tubular and the drill stand can be brought into contact and joined together, while mud circulation can continue uninterrupted.

5. A coupler and slips assembly for use with a drill string comprising tubulars which slips assembly comprises a slips base and a slips body and in which there are a plurality of slip segments which, when positioned adjacent to each other, form a collar, which collar is larger than the diameter of the tubular body of the tubular body of the tubular at the top of the drill string and smaller than the diameter of the upset shoulder of the said tubular, including a segment moving means for moving said segments together to form a collar which can be slidably located around the body of the said tubular; said slips assembly being operated upside down to act upon the upset shoulder of a tubular, or the lowest tubular of a stand of tubulars, when forcing or snubbing a tubular, or stand of tubulars, in a downwards direction, into a high pressure space, said high pressure place being inside the upper half of said coupler for use in continuous drilling in which a drill string is rotated by rotating means and drilling fluid is circulated down the drill string, which coupler comprises means to grip the drill string and means to grip and seal a tubular lowered from substantially above, and the upper and lower sections of the coupler are inside a chamber separated into an upper half and a lower half by a blind preventer which, in its closed position prevents escape of drilling fluid from the drill stand, whereby when the blind preventer is opened the tubular and the drill string can be brought into contact and joined together.

6. A coupler and slips assembly for use with a drill string comprising tubulars which slips assembly comprises a slips base and a slips body and in which there are a plurality of slip segments which, when positioned adjacent to each other, form a collar, which collar is larger than the diameter of the tubular body of the tubular body of the tubular at the top of the drill string and smaller than the diameter of the upset shoulder of the said tubular, including slips segment moving means for moving said slips segments together to form a collar which can be slidably located around the body of the said tubular; said slips assembly being operated upside down to act upon the upset shoulder of a tubular, or the lowest tubular of a stand of tubulars, when forcing or snubbing a tubular, or stand of tubulars, in a downwards direction, into a high pressure space, said high pressure place being inside the lower half of a coupler for use in continuous drilling in which a drill string is rotated by rotating means and drilling fluid is circulated down the drill string, which coupler comprises a means to grip the drill string and means to grip and seal a tubular lowered from substantially above, and the upper and lower sections of the coupler are inside a chamber separated into an upper half and lower half by a blind preventer which, in its closed position prevents escape of drilling fluid from the drill stand, whereby when the blind preventer is opened the tubular and the drill stand can be brought into contact and joined together.

7. A coupler and slips assembly for use with a drill string comprising tubulars which slips assembly comprises a slips base and a slips body and in which there are a plurality of slips which, when positioned adjacent to each other, form a collar, which collar is larger than the diameter of the tubular body of the tubular body of the tubular at the Lop of the drill string and smaller than the diameter of the upset shoulder of the said tubular, including slips moving means for moving said slips together to form a collar which can be slidably located around the body of the said tubular; said slips being positioned outside and above said coupler for use in continuous drilling in which a drill string is rotated from a top drive rotating means and drilling fluid is circulated down the drill string, which coupler comprises means to grip the drill string and means to grip and seal a tubular lowered from substantially above, and the upper and lower portions of said coupler being inside a chamber separated into an upper half and a lower half by a blind preventer which, in its closed position prevents escape of drilling fluid from the drill string, whereby when the blind preventer is opened the tubular and the drill string can be brought into contact and joined together.

8. A method for joining a tubular having an upset shoulder to a drill string using a coupler which incorporates slips, which slips comprise a plurality of slip segments having surfaces at an angle to the axis of the tubular which, when positioned adjacent to each other, form a collar, which collar is larger than the diameter of the tubular body of the tubular and smaller than the diameter of said upset shoulder, including segment moving means for moving said segments together to form said collar, said method comprising:

(a) lowering the string until said upset shoulder contacts said slips segments, at which time the weight of the string is supported by said slips segments, which segments are on a slips base wedged within a slips body, which body comprises a continuous ring;

(b) a tubular is then joined to the string; and (c) the slips base is then moved away from the slips body and said slips segments are moved outwards from the axis of the string until they are clear for the passage of said upset shoulder through said slips segments.

9. A method as claimed in claim 8 in which said angle of said surfaces of said slips segments are less than the angle of said upset shoulder whereby downward pressure on the segments due to the weight of the drill string is applied at least to the upper portion of said upset shoulder.

10. A method as claimed in claim 9 wherein the difference between the angle of said slip surfaces and said angle of said upset shoulder is less than 2 degrees.

11. A method as claimed in claim 8 in which said segments are slidably mounted in keyways and said segments are constrained by said keyways to move in and out equally in a controlled path to form said collar and align it around the tubular.

12. A method as claimed in claim 8 including the step of moving said slips base upwardly and downwardly by mechanical, electrical or hydraulic means.

13. A method as claimed in claim 12 including the step of retracting said slip base by the action of a spring, and mechanical, electrical or hydraulic pressure is used to extend said slips base.

14. A method as claimed in claim 8 including the step of rotating said slips assembly relative to the string.

15. A method as claimed in claim 8 in which said slips segments apply a force over the entire surface of said upset shoulder.

16. A method as claimed in claim 8 in which, if the axial force of the weight of the string exceeds the elastic deformation of the surface of the upset shoulder, the resulting plastic deformation takes place preferentially at the least stressed part of the tubular.

17. A slips assembly for preventing axial movement of a tubular, said tubular including a joint box having a shoulder including a surface portion extending at an angle with respect to the axis of the tubular, wherein said slips assembly comprises:

(a) a slips base;

(b) a slips body;

(c) a plurality of slips segments supported in said slips body and connected to said slips base;

(d) each of said slips segments having a tubular engaging surface extending at an angle such as to engage said shoulder surface portion when said slips segments are moved radially inward such as to form a collar about said shoulder portion; and (e) actuating means at least partially contained within said slips body, and connected to said slips base, whereby said actuating means move said slips segments radially inwardly toward said tubular and force said tubular engaging surfaces against said shoulder surface portion of said joint box.

18. The slips assembly according to claim 17 wherein said actuating means comprise a cylinder portion in said slips body, a piston element having one end portion extending into said cylinder portion and an opposite end connected to said slips base.

19. The slips assembly according to claim 17 wherein said actuating means are substantially fully contained within said slips body when said slips surfaces are in engagement with said shoulder surface portion of the tubular.

20. The slips assembly according to claim 18 wherein said actuating means are substantially fully contained within said slips body when said slips surfaces are in engagement with said shoulder surface portion of the tubular.

21. The slips assembly according to claim 17 wherein the total vertical height of the slips assembly including said actuating means is substantially equal to the vertical thickness of said slips body plus the vertical thickness of said slips base when said slips segments are in engagement with said tubular shoulder.

22. The slips assembly according to claim 18 including fluid passage means within said slips body for supplying drilling fluid to said cylinder portion.

23. The slips assembly according to claim 17 wherein said actuating means move said slips base in one direction, and including spring means for moving said slips base in the opposite direction.

24. The slips assembly of claim 17 in combination with a continuous circulation coupler, said coupler including a pressure hull forming a high pressure fluid chamber, and wherein said slips assembly is connected to said coupler for making and breaking tubular tool joints while continuing to circulate drilling fluid down an associated bore hole.

25. The slips assembly of claim 17 in combination with a continuous circulation coupler, said coupler including a pressure hull forming a high pressure fluid chamber, and wherein said slips assembly is positioned within said high pressure fluid chamber.

26. The slips assembly of claim 17 in combination with a continuous circulation coupler, said coupler including a pressure hull forming a high pressure fluid chamber, and wherein said slips assembly is positioned externally of said coupler pressure hull and operatively connected to said coupler.

27. The slips assembly and actuating means according to claim 17 wherein the vertical height of the entire suns assembly and actuator means is substantially equal to or less than the vertical length of the tool joint when formed by said tubular and the adjacent tubular joined therewith.

* * * * *